US009309840B2

(12) United States Patent
Jentz et al.

(10) Patent No.: US 9,309,840 B2
(45) Date of Patent: Apr. 12, 2016

(54) ENGINE COOLING SYSTEM MOTOR DRIVEN VACUUM PUMP

(71) Applicant: Ford Global Technologies, LLC, Dearborn, MI (US)

(72) Inventors: Robert Roy Jentz, Westland, MI (US); Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 701 days.

(21) Appl. No.: 13/633,804

(22) Filed: Oct. 2, 2012

(65) Prior Publication Data

US 2014/0095049 A1 Apr. 3, 2014

(51) Int. Cl.
*F02M 25/08* (2006.01)
*F02M 65/00* (2006.01)

(52) U.S. Cl.
CPC ..... *F02M 25/0818* (2013.01); *F02M 25/0809* (2013.01); *F02M 65/00* (2013.01); *F02M 65/006* (2013.01)

(58) Field of Classification Search
CPC ..... F02M 25/0809; F02M 25/0818; F02M 65/006; F02M 65/00; F01P 2005/125
USPC ..... 123/41.46
See application file for complete search history.

(56) References Cited

U.S. PATENT DOCUMENTS 1,900,586 A * 3/1933 Rippe ..... 236/35
3,283,527 A * 11/1966 Cauvin ..... 62/183
4,691,668 A * 9/1987 West ..... 123/41.12
5,269,665 A 12/1993 Sadler et al.
5,482,432 A * 1/1996 Paliwoda et al. ..... 415/168.2
6,314,797 B1 * 11/2001 Dawson et al. ..... 73/49.2
6,321,727 B1 * 11/2001 Reddy et al. ..... 123/520
6,880,383 B2 * 4/2005 Mc Lain et al. ..... 73/49.2
7,275,378 B2 10/2007 Errington et al.
8,915,720 B2 * 12/2014 Parikah et al. ..... 417/362
2009/0169400 A1 * 7/2009 Paarikh et al. ..... 417/362
2009/0266097 A1 * 10/2009 Hamilton ..... 62/236
2009/0277251 A1 * 11/2009 Takakura ..... 73/40.7
2010/0083457 A1 4/2010 Norell et al.
2011/0139130 A1 * 6/2011 Siddiqui ..... 123/520
2011/0142687 A1 6/2011 Exner et al.
2011/0168140 A1 * 7/2011 DeBastos et al. ..... 123/521
2011/0174244 A1 * 7/2011 Maki et al. ..... 123/41.1
2011/0308241 A1 * 12/2011 Huff et al. ..... 60/327
2013/0297234 A1 * 11/2013 Criel et al. ..... 702/51
2015/0120133 A1 * 4/2015 Dudar et al. ..... 701/34.4

FOREIGN PATENT DOCUMENTS

DE 19960894 A1 7/2001

OTHER PUBLICATIONS

Anonymous, "Variable Maximum Cooilng Fan Speed Strategy in a Motor Vehicle Based on Fan Loading," IPCOM No. 000131694, Published Nov. 15, 2005, 2 pages.

* cited by examiner

*Primary Examiner* — Hieu T Vo
*Assistant Examiner* — Sherman Manley
(74) *Attorney, Agent, or Firm* — James Dottavio; Alleman Hall McCoy Russell & Tuttle LLP

(57) ABSTRACT

Embodiments for monitoring fuel system degradation are provided. In one example, a method comprises driving a cooling fan with an electric motor in a vehicle, and during selected conditions, also driving a vacuum pump with the electric motor through a clutch. In this way, fuel system degradation may be indicated without use of a separate motor to drive a pressure building device.

19 Claims, 4 Drawing Sheets

ENGINE COOLING SYSTEM MOTOR DRIVEN VACUUM PUMP

FIELD

The present disclosure relates to a vehicle fuel system.

BACKGROUND AND SUMMARY

Vehicles may be fitted with evaporative emission control systems to reduce the release of fuel vapors to the atmosphere. For example, vaporized hydrocarbons (HCs) from a fuel tank may be stored in a fuel vapor canister packed with an adsorbent which adsorbs and stores the vapors. At a later time, when the engine is in operation, the evaporative emission control system allows the vapors to be purged into the engine intake manifold for use as fuel. However, leaks in the emissions control system can inadvertently allow fuel vapors to escape to the atmosphere. Thus, various approaches are used to identify such leaks.

One such approach for leak detection includes sealing off the fuel tank, canister, and various conduits from atmosphere and applying pressure to the sealed off system, via a vacuum pump for example. Once a threshold pressure has been reached in the system, the pump may be shut off and leaks may be detected based on a rate of bleed-up or bleed-down of the pressure. However, the vacuum pump utilizes a separate motor, thus consuming additional energy and reducing fuel economy.

The inventors have recognized the above issues and offer a method to at least partly address them. In one embodiment, a method comprises driving a cooling fan with an electric motor in a vehicle, and during selected conditions, also driving a vacuum pump with the electric motor through a clutch.

In this way, a motor used to drive a vehicle cooling fan may also drive a vacuum pump. In one example, the vacuum pump may be operated to apply vacuum to a fuel system of the vehicle during a fuel system leak detection test. By using an existing motor of the vehicle, additional energy expenditure by the engine to drive the vacuum pump may be reduced. Further, the cooling fan may continue to be operated after an engine shut off to ensure adequate engine cooling, thus allowing the vacuum pump to be driven, and hence the leak detection test performed, while the engine is not operating. In doing so, factors that may confound accurate leak detection, such as high engine temperature, fuel sloshing, etc., may be reduced.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
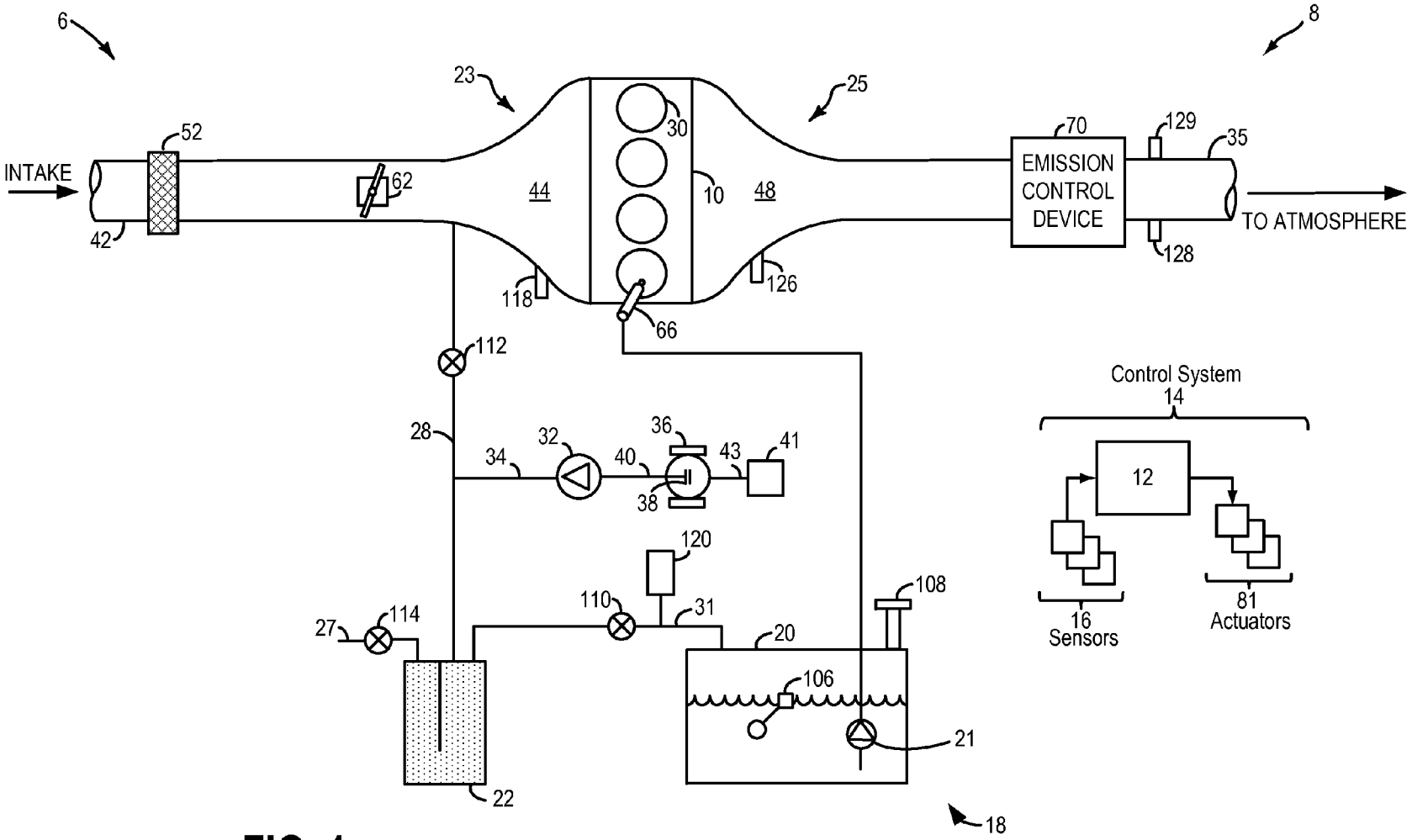
FIG. 1 shows a schematic depiction of a vehicle including an engine, a fuel system, and a vacuum pump.
Figure 3:
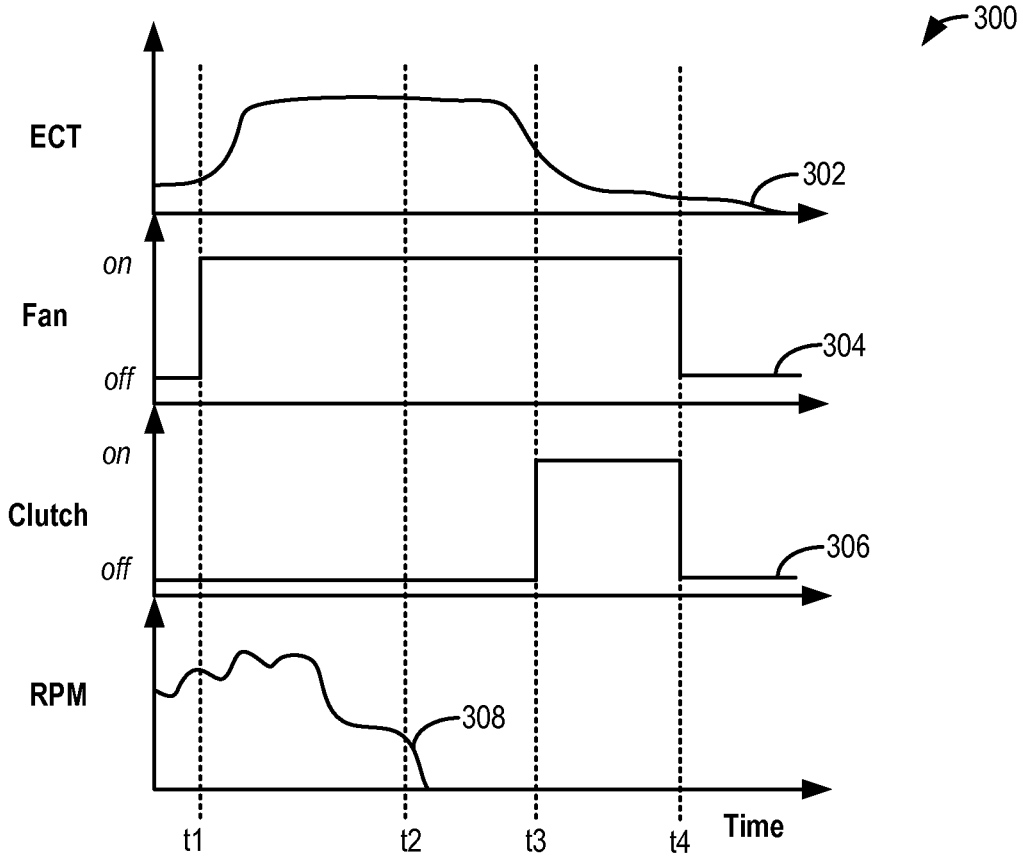
FIG. 3 is a diagram illustrating example engine operating parameters during the execution of the method of FIG. 2.
Figure 4:
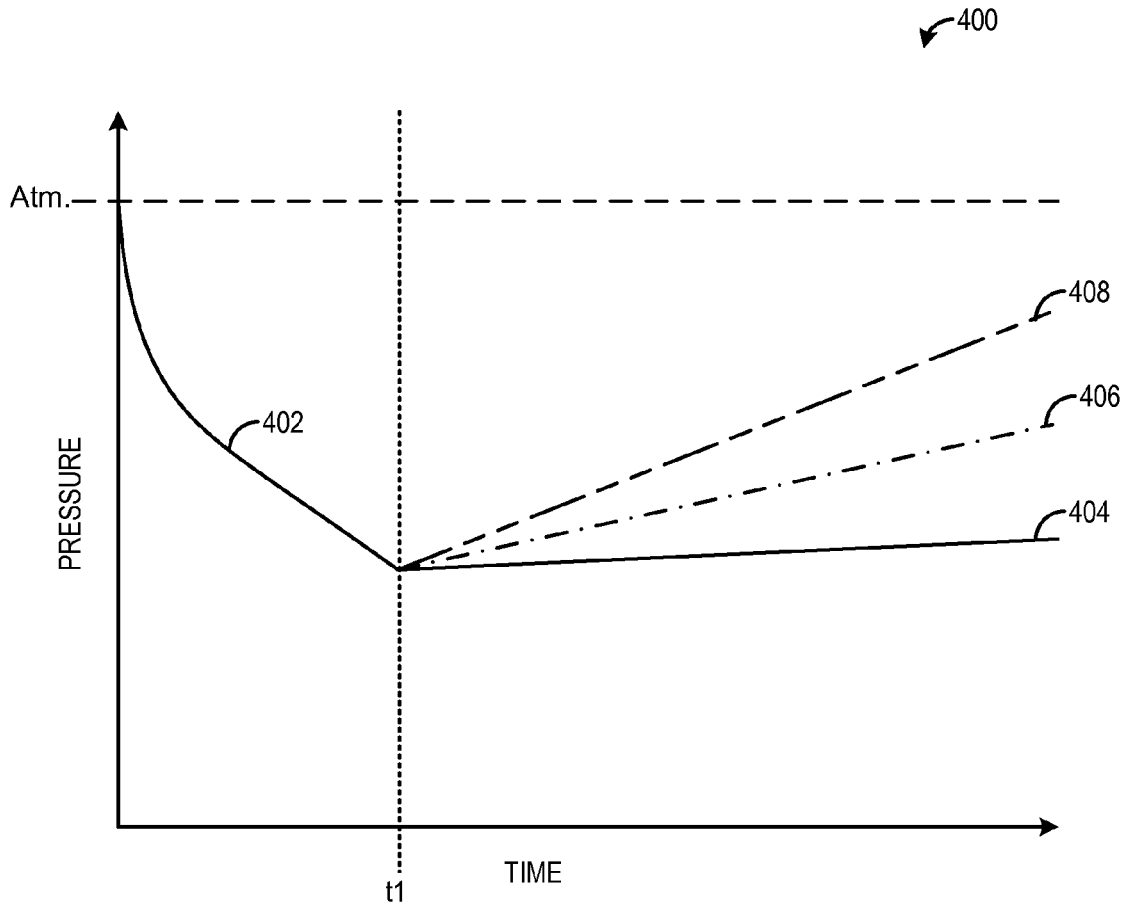
FIG. 4 is a diagram illustrating example fuel system pressure changes during a leak detection test.

An existing engine motor, such as a motor to operate an engine cooling fan or cooling pump, may include a clutch coupling the motor to a vacuum pump. When the clutch is engaged, the vacuum pump may be driven by the motor. The vacuum pump may be used to apply negative pressure to a fuel system in order to detect leaks, for example. FIG. 1 is a vehicle including a fuel system and a controller configured to carry out the method of FIG. 2. FIGS. 3 and 4 illustrate various parameters of the leak detection test carried out in FIG. 2.

FIG. 1 shows a schematic depiction of a vehicle system 6 that can derive propulsion power from engine system 8. Vehicle system 6 may be a conventional vehicle powered solely through combustion, or it may be a hybrid vehicle system that can derive propulsion power from engine system 8 and/or an on-board energy storage device (not shown), such as a battery system. An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18. Fuel system 18 includes a fuel tank 20 coupled to a fuel pump 21 and a fuel vapor canister 22. During a fuel tank refueling event, fuel may be pumped into the vehicle from an external source through refueling door 108. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via conduit 31, before being purged to the engine intake 23.

Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 by opening canister purge valve 112. While a single canister 22 is shown, it will be appreciated that fuel system 18 may include any number of canisters.

Canister 22 includes a vent 27 for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister.

If vehicle system 6 is a hybrid vehicle, it may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, a fuel tank isolation valve 110 may be optionally included in conduit 31 such that fuel tank 20 is coupled to canister 22 via the valve. During regular engine operation, isolation valve 110 may be kept closed to limit the amount of diurnal or "running loss" vapors directed to canister 22 from fuel tank 20. During refueling operations, and selected purging conditions, isolation valve 110 may be temporarily opened, e.g., for a duration, to direct fuel vapors from the fuel tank 20 to canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits. While the depicted example shows isolation valve 110 positioned along conduit 31, in alternate embodiments, the isolation valve may be mounted on fuel tank 20.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 coupled between the fuel tank and canister 22, specifically between the fuel tank and isolation valve 110, in alternate embodiments, the pressure sensor may be directly coupled to fuel tank 20. In still other embodiments, a first pressure sensor may be positioned upstream of the isolation valve (between the isolation valve and the canister) while a second pressure sensor is positioned downstream of the isolation valve (between the isolation valve and the fuel tank), to provide an estimate of a pressure difference across the valve.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake. An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may open isolation valve 110 while closing canister purge valve (CPV) 112 to direct refueling vapors into canister 22 while preventing fuel vapors from being directed into the intake manifold.

As another example, the fuel system may be operated in a refueling mode (e.g., when fuel tank refueling is requested by a vehicle operator), wherein the controller 12 may open isolation valve 110, while maintaining canister purge valve 112 closed, to depressurize the fuel tank before allowing fuel to be added therein. As such, isolation valve 110 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 12 may open canister purge valve 112 while closing isolation valve 110. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister. For example, one or more oxygen sensors (not shown) may be coupled to the canister 22 (e.g., downstream of the canister), or positioned in the engine intake and/or engine exhaust, to provide an estimate of a canister load (that is, an amount of fuel vapors stored in the canister). Based on the canister load, and further based on engine operating conditions, such as engine speed-load conditions, a purge flow rate may be determined.

Controller 12 may also be configured to intermittently perform leak detection routines on fuel system 18 to confirm that the fuel system is not degraded. As such, leak detection routines may be performed while the vehicle is running with the engine on (e.g., during an engine mode of hybrid vehicle operation) or with the engine off (e.g., during a battery mode of hybrid vehicle operation). The leak tests performed may include applying a positive pressure on the fuel system for a duration (e.g., until a target fuel tank pressure is reached) and then sealing the fuel system while monitoring a change in fuel tank pressure (e.g., a rate of change in the pressure, or a final pressure value). The leak tests performed may also include applying a negative pressure on the fuel system for a duration (e.g., until a target fuel tank vacuum is reached) and then sealing the fuel system while monitoring a change in fuel tank pressure (e.g., a rate of change in the vacuum level, or a final pressure value).

Engine system 8 further includes a vacuum pump 32 that may be used to apply vacuum on canister 22 to pressurize fuel system 18. Specifically, the vacuum pump may be operated to route vacuum from the pump to the canister 22 of fuel system 18 in order to apply negative pressure to the fuel system. Therein, fuel system degradation is indicated in response to a change in fuel system pressure following application of a negative pressure generated at the vacuum pump. In some embodiments, the vacuum pump may be used to apply positive pressure to the fuel system. For example, exhaust produced by the vacuum pump may be routed to canister 22 of fuel system 18. This enables application of a positive pressure, generated at the vacuum pump, on the fuel system. To provide the application of either positive or negative pressure from the vacuum pump, multiple conduits may couple vacuum pump 32 to purge line 28. For example, conduit 34 may couple a first outlet of vacuum pump 32 to purge line 28 to apply vacuum to the fuel system. However, a second conduit (not shown) may couple a second outlet of the vacuum pump to purge line 28 to direct vacuum pump exhaust to the fuel system. If multiple conduits coupling vacuum pump to purge line 28 are present, each conduit may be selectively opened and closed via on/off valves.

Vacuum pump 32 may be operated via an existing vehicle motor in order to conserve packaging space in the vehicle. For example, engine cooling fans or pumps may be electrically-operated via a motor. An example motor 36 is depicted in FIG. 1. Motor 36 may be coupled to vacuum pump via a clutch 38. Motor may also be coupled to an engine cooling fan 41 via shaft 43. When engaged, clutch 38 may drive shaft 40 coupled to vacuum pump 32 in order to allow vacuum pump to generate vacuum. Clutch 38 is configured to transmit power from motor 36 to vacuum pump 32. Motor 36 may drive another suitable engine component, such as an engine cooling pump.

To perform the leak test, following a key-off event, canister purge valve 112 and canister vent valve 114 may be closed and isolation valve 110 may be opened to seal the fuel system. Clutch 38 may be then engaged to couple vacuum pump 32 to motor 36. Because motor 36 may drive a cooling fan or pump, motor 36 may continue to operate even after the key-off event, to ensure adequate cooling of the engine. In this way, vacuum pump 32 may be operated without consuming extra energy and without a vehicle operator detecting the leak test is occurring. By sealing the fuel system and operating vacuum pump 32, negative pressure may be applied to the fuel system.

Then, after a threshold fuel tank negative pressure has been reached, the isolation valve may be closed while a fuel tank pressure bleed-up is monitored at pressure sensor 120. Based on the pressure bleed-up rate (or vacuum decay rate) and the final stabilized fuel tank pressure following the application of the negative pressure, the presence of a fuel system leak may be determined. For example, in response to a vacuum decay rate that is faster than a threshold rate, a leak may be determined and fuel system degradation may be indicated.

It will be appreciated that the fuel system may be operated in various purging modes based on whether a canister purging operation occurred after pressure was applied for leak testing, and further based on the nature of the applied pressure. For example, the controller may operate the fuel system in a first purging mode if a purging operation occurs immediately after a negative pressure was applied for a negative pressure leak test. Herein, the controller may decrease the duration of the purging to compensate for fuel vapors that may have been purged from the canister to the engine intake during the leak test. If negative pressure was not applied to the fuel tank immediately before the purging, the controller may operate the fuel system in a second (e.g., default) purging mode wherein the purge flow rate and duration is based on the canister load and engine operating conditions.

Returning to FIG. 1, vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, MAP sensor 118, and pressure sensor 129. Other sensors such as additional pressure, temperature, air/fuel ratio, and composition sensors may be coupled to various locations in the vehicle system 6. As another example, the actuators may include fuel injector 66, isolation valve 110, purge valve 112, vent valve 114, motor 36, clutch 38, and throttle 62. The control system 14 may include a controller 12. The controller may receive input data from the various sensors, process the input data, and trigger the actuators in response to the processed input data based on instruction or code programmed therein corresponding to one or more routines. An example control routine is described herein with regard to FIG. 2.

Figure 2:
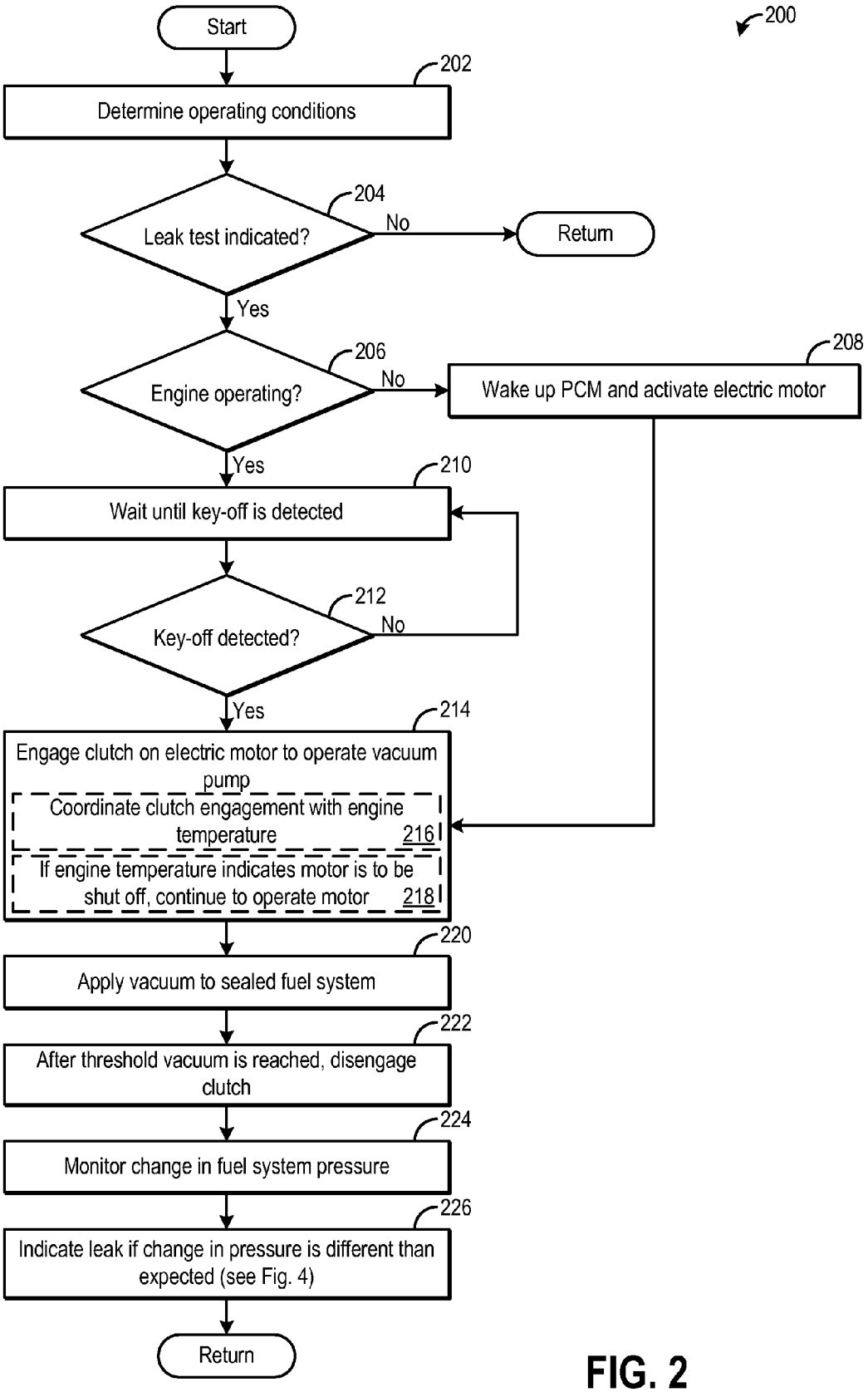
FIG. 2 is a flow chart illustrating a method for performing a fuel system leak detection test according to an embodiment of the present disclosure.

FIG. 2 illustrates a method 200 for performing a leak detection test using a vacuum pump. As explained above with respect to FIG. 1, the vacuum pump (such as vacuum pump 32) may be driven by an electric motor (e.g., motor 36) that also drives an engine cooling fan or cooling pump. Method 200 may be carried out by an engine control system, such as controller 12.

At 202, method 200 includes determining engine operating parameters. The engine operating parameters may include engine speed, load, fueling conditions (e.g., amount of fuel in fuel tank, whether the fuel system is in a purge mode, etc.), and time since a previous leak detection test was performed. At 204, it is determined if a leak test is indicated. The leak test may be performed periodically, such as every 100 miles driven. Further, the leak test may be performed only under certain conditions. For example, the leak test may only be performed if the engine is off, if the engine temperature is below a threshold, if the fuel system is in standard, non-purge mode, etc. If the leak test is not indicated, method 200 returns.

If the leak test is indicated, for example if a threshold amount of time or distance traveled by the vehicle has elapsed since a previous test was performed, method 200 proceeds to 206 to determine if the engine is operating. In some embodiments, the leak test may be performed if the engine is on or off. However, in other embodiments, the leak test may only be performed if the engine is off, to reduce testing noise resulting from excess engine heat, fuel sloshing, etc. If the engine is not operating, method 200 proceeds to 208 to wake up the engine powertrain control module (PCM) and activate the electric motor. Method 200 then proceeds to 214, which will be explained below.

If the engine is operating, method 200 proceeds to 210 to wait until a key-off event is detected. As explained earlier, by waiting until the engine shuts down, testing noise may be reduced, increasing the accuracy of the leak detection test. However, in some embodiments, the leak test may be performed when the engine is operating. At 212, it is determined if a key-off event has been detected. If not, method 200 loops back to 210 to continue to wait for a key-off event.

If a key-off event is detected, method 200 proceeds to 214 to engage the clutch on the electric motor to activate the vacuum pump. Immediately following an engine shut-down, the electric motor may continue to operate in order to drive the cooling fan or cooling pump, to ensure adequate engine cooling. Thus, following the key-off event, the electric motor is operating. If the motor is not operating, for example if the engine temperature is not warm enough to warrant operating the cooling fan or pump, the motor may be activated in order to perform the leak test. The clutch engagement may be coordinated with engine temperature, as indicated at 216. For example, the clutch may be engaged once engine temperature has reached a threshold temperature, to prevent fuel system pressure rise that may occur when the engine is warm. If the engine temperature is low enough to trigger the motor to be deactivated, the motor may continue to operate to drive the vacuum pump, as indicated at 218.

At 220, vacuum (e.g., negative pressure) is applied to the sealed fuel system. The fuel system may be sealed prior to activation of the vacuum pump by closing one or more valves that couple the fuel system to atmosphere, such as purge valve 112 and vent valve 114. Vacuum may be applied by operating the vacuum pump, as explained above, which is coupled via a conduit to the fuel system (via the purge line 28, for example). At 222, after a threshold pressure in the fuel system is reached, the clutch is disengaged to deactivate the vacuum pump. The threshold pressure in the fuel system may be a suitable pressure that is sufficiently different from the starting pressure to allow for monitoring of the change in fuel pressure as the pressure returns to starting pressure. For example, the threshold pressure may be 10% greater than the starting pressure, 50% greater, 100% greater, or other suitable amount.

At 224, the fuel system pressure may be monitored. In one example, the fuel system pressure is a fuel tank pressure estimated by a pressure sensor coupled between the fuel tank and the canister of the fuel system. Monitoring the fuel system pressure may include monitoring a rate of change in the fuel tank pressure and/or monitoring a stabilized fuel tank pressure following the application of the pressure.

As such, following isolation of the fuel system, the fuel system pressure (herein, the fuel tank pressure) may be expected to equilibrate back towards atmospheric pressure at a defined rate (based on a reference orifice size). If a leak is present, the monitored fuel tank pressure may be expected to reach to the atmospheric pressure at a faster rate.

Accordingly a rate of change in the fuel tank pressure following application of the negative pressure may be determined and compared to a threshold rate. If the rate of fuel system pressure decay is larger than the threshold rate, (that is, if following application of the negative pressure, the rate of change in fuel tank pressure is faster than the threshold rate), then, at 226, fuel system degradation may be determined. As used herein, the rate of change may be an absolute rate of change in the fuel tank (negative) pressure. Fuel system degradation may be indicated by setting a diagnostic code (e.g., by setting a malfunction indication light). An orifice size of the leak may be determined based on a difference between the absolute rate of change in the fuel system pressure and the threshold rate. Specifically, as the difference increases, a larger orifice size of the leak may be indicated. In comparison, if the rate of fuel system pressure decay is smaller than the threshold rate (that is, if following application of the negative pressure, the rate of change in fuel tank pressure is slower than the threshold rate), no fuel system degradation (based on the negative pressure leak test) may be determined. Additional detail about detecting the leak based on pressure change is presented below with respect to FIG. 4.

If fuel system degradation is detected, the controller may take default action, such as notifying an operator of the vehicle by lighting the malfunction indicator lamp, setting a diagnostic code for later engine service, and/or adjusting engine operating parameters. For example, if a leak in the fuel system is detected, purging of fuel vapors to the engine may be performed more or less frequently.

Thus, method 200 of FIG. 2 provides for detecting fuel system degradation based on a change in fuel system pressure after pressure has been applied to the sealed fuel system. Pressure may be applied by a vacuum pump driven by an electric motor that also drives an engine cooling fan or cooling pump. In doing so, a separate motor for the vacuum pump may be dispensed with, reducing the engine packaging space used for the vacuum pump. Further, if the leak test is performed during a condition where the cooling fan or pump is already operating, additional energy to operate the motor specifically for the leak test may be reduced.

Turning now to FIG. 3, a diagram 300 illustrates various engine operating parameters prior to and during the leak detection test carried out according to the method of FIG. 2. Specifically, engine temperature, electric motor operation, clutch engagement (which drives the vacuum pump), and engine speed are depicted. For each operating parameter, time is depicted along the horizontal axis and values of the respective operating parameters are depicted along the vertical axis.

Prior to time t1, the engine is operating at a relatively cool temperature, for example following an engine start, as indicated by curve 302. As a result, the electric motor is not operated (as shown by curve 304), as the cooling fan or pump is not operated to cool the engine. Additionally, the vacuum pump clutch on the motor is not engaged (as seen by curve 396), and the engine is being operated, as evidenced by the positive, non-idle engine speed shown by curve 308.

At time t1, the engine temperature has reached sufficient temperature to trigger activation of the motor. However, the clutch remains disengaged. At time t2, the engine is shut-off, and engine speed drops to zero. Initially, the engine temperature is still above a threshold temperature in which it is cooled by the cooling fan or pump. This temperature is also above a threshold temperature for initiating the leak detection test, so the clutch remains disengaged.

At time t3, the engine temperature drops below a leak detection threshold temperature, and the clutch is engaged. As the engine temperature is still relatively warm, the motor remains activated, and is able to drive the vacuum pump. In the time following t3, negative pressure in the fuel system may build until a threshold pressure is reached. At time t4, the clutch is disengaged to stop the application of vacuum, and then the fuel system pressure is monitored to determine if degradation of the fuel system is present. Further, as shown in FIG. 3, this may coincide with the engine temperature dropping to a low enough temperature to deactivate the electric motor, as engine cooling is no longer indicated.

FIG. 4 is a diagram 400 illustrating pressure change in a fuel system following the application of negative pressure during a leak detection test, such as the test illustrated by the method of FIG. 2. Time is illustrated along the horizontal axis, and pressure is illustrated along the vertical axis. Atmospheric pressure is indicated by the dashed line at the top of the vertical axis.

As shown by curve 402, when negative pressure is applied to a sealed fuel system, the pressure in the system decreases. Once a threshold pressure in the system has been reached at time t1, the application of pressure may be stopped, by disengaging the clutch coupling the electric motor to the vacuum pump, for example. Once the application of pressure has ceased, pressure may slowly rise back towards atmospheric pressure. A non-degraded fuel system that does not include a leak may have a rate of pressure rise illustrated by curve 404. However, if the fuel system is degraded and a leak is present, the pressure may increase faster than without a leak. The size of the orifice of the leak may be determined based on the rate of pressure change. For example, curve 406 illustrates a fuel system with a leak orifice of a first, smaller size, and thus the rate of pressure change is greater than the rate illustrated by curve 404 but less than the rate of change of a fuel system with a leak orifice of a second, larger size, illustrated by curve 408.

The engine control system may have a map corresponding to the rate of applied pressure (shown by curve 402), rate of pressure change expected with no leak (shown by curve 404), and rate of pressure change expected with a leak of a known size, illustrated by curve 406, for example. The pressure change curve for the system with a leak of a known size may represent a leak orifice size that is small enough to be tolerated, and thus a rate that is greater than the known leak orifice size may trigger an indication that the fuel system is degraded. Furthermore, a change in the rate of applied pressure, illustrated by curve 402, may also indicate a degraded fuel system. For example, if the fuel system does not reach the threshold pressure, a leak may be indicated.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

driving a cooling fan with an electric motor in a vehicle; and during selected conditions, also driving a vacuum pump with the electric motor through a clutch, the selected conditions comprising performing a fuel system leak detection test on a fuel system of the vehicle.

2. The method of claim 1, wherein the selected conditions further comprise following a key-off event where the cooling fan is still driven by the electric motor.

3. The method of claim 1, wherein the selected conditions further comprise a temperature of an engine of the vehicle being below a threshold.

4. The method of claim 1, wherein performing the fuel system leak detection test comprises applying vacuum to the fuel system with the vacuum pump and indicating a fuel system leak in response to a change in fuel system pressure following the application of vacuum.

5. The method of claim 4, wherein the clutch is engaged to drive the vacuum pump to apply pressure to the fuel system.

6. The method of claim 4, further comprising disengaging the clutch to deactivate the vacuum pump once a threshold fuel system pressure has been reached.

7. A method for an engine having a fuel system, comprising:

during an engine off condition, applying vacuum to the fuel system with a vacuum pump operated via an electric fan motor; and indicating fuel system degradation in response to a change in fuel system pressure after a threshold level of vacuum has been applied by the vacuum pump.

8. The method of claim 7, wherein applying vacuum to the fuel system with the vacuum pump operated via the electric fan motor further comprises engaging a clutch coupled to the motor in order to drive a shaft coupled to the vacuum pump.

9. The method of claim 7, wherein the electric fan motor is operated during the engine off condition to cool the engine.

10. The method of claim 7, wherein indicating fuel system degradation in response to the change in fuel system pressure includes indicating a fuel system leak based on an absolute rate of change in the fuel system pressure being higher than a threshold rate.

11. The method of claim 10, wherein an orifice size of the fuel system leak is based on a difference between the absolute rate of change in the fuel system pressure and the threshold rate.

12. The method of claim 7, wherein the fuel system pressure is a fuel tank pressure estimated by a pressure sensor coupled between a fuel tank and a canister of the fuel system.

13. The method of claim 7, further comprising isolating the fuel system from atmosphere prior to applying vacuum to the fuel system.

14. A method for a fuel system of an engine, comprising:

following a key-off event, cooling the engine by operating an electric cooling fan;

applying vacuum to the fuel system by engaging a clutch coupled to a motor of the electric cooling fan, the clutch configured to transmit power from the motor to a vacuum pump; and indicating fuel system degradation in response to a change in fuel system pressure following the application of vacuum.

15. The method of claim 14, wherein the clutch is engaged to apply vacuum to the fuel system once the engine has cooled to a threshold temperature.

16. The method of claim 14, further comprising, prior to monitoring the change in fuel system pressure, disengaging the clutch to deactivate the vacuum pump once a threshold pressure is reached.

17. The method of claim 14, wherein indicating fuel system degradation in response to the change in fuel system pressure following application of pressure includes indicating a fuel system leak based on an absolute rate of change in the fuel system pressure being higher than a threshold rate.

18. The method of claim 17, further comprising indicating a leak of a first size if the absolute rate of change in the fuel system pressure is a first rate, and indicating a leak of a second, greater size if the absolute rate of change in the fuel system pressure is a second, greater rate.

19. The method of claim 14, wherein the fuel system pressure is a fuel tank pressure estimated by a pressure sensor coupled between a fuel tank and a canister of the fuel system.

* * * * *